US007239214B2

(12) United States Patent
Hino

(10) Patent No.: US 7,239,214 B2
(45) Date of Patent: Jul. 3, 2007

(54) TWO-PORT NON-RECIPROCAL CIRCUIT DEVICE AND COMMUNICATION APPARATUS

(75) Inventor: Seigo Hino, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/536,005

(22) Filed: Sep. 28, 2006

(65) Prior Publication Data

US 2007/0030089 A1 Feb. 8, 2007

Related U.S. Application Data

(63) Continuation of application No. PCT/JP2005/023907, filed on Dec. 27, 2005.

(30) Foreign Application Priority Data

Jan. 28, 2005 (JP) ..... 2005-021647

(51) Int. Cl.
*H01P 1/36* (2006.01)

(52) U.S. Cl. ..... 333/24.2; 333/1.1

(58) Field of Classification Search ..... 333/24.2, 333/1.1

See application file for complete search history.

(56) References Cited

U.S. PATENT DOCUMENTS 6,900,704 B2 5/2005 Hasegawa
6,940,360 B2 * 9/2005 Takeda et al. ..... 333/24.2
6,965,276 B2 11/2005 Hasegawa
2004/0263278 A1 12/2004 Hino

FOREIGN PATENT DOCUMENTS

JP 2003-110309 4/2003
JP 2004-088744 3/2004
JP 2005-020195 1/2005

OTHER PUBLICATIONS

Official Communication issued in the corresponding International Application No. PCT/JP2005/023907, mailed on Jan. 31, 2006.

* cited by examiner

*Primary Examiner*—Stephen E. Jones
(74) *Attorney, Agent, or Firm*—Keating & Bennett, LLP

(57) ABSTRACT

A two-port non-reciprocal circuit device has one end of a first central electrode electrically connected to an input port and the other end thereof electrically connected to an output port. One end of a second central electrode is electrically connected to the output port and the other end thereof is electrically connected to a ground port. A resonant capacitor and a terminating resistor are electrically connected in parallel between the input port and the output port. A resonant capacitor is electrically connected between the output port and the ground port. Matching capacitors for impedance matching are electrically connected between the input port and an input terminal and between the output port and an output terminal, respectively. A coupling capacitor element is electrically connected between the input terminal and the output terminal.

13 Claims, 9 Drawing Sheets

TWO-PORT NON-RECIPROCAL CIRCUIT DEVICE AND COMMUNICATION APPARATUS

BACKGROUND OF THE INVENTION

1. Field of the Invention

The present invention relates to two-port non-reciprocal circuit devices. In particular, the present invention relates to a two-port non-reciprocal circuit device, such as an isolator, used in a microwave band and to a communication apparatus.

2. Description of the Related Art

A two-port isolator is disclosed in Japanese Unexamined Patent Application Publication No. 2004-88744 (Patent Document 1) as a two-port non-reciprocal circuit device in the related art. A basic equivalent circuit of the two-port isolator is shown in FIG. 15. In a two-port isolator 301, one end of a first central electrode L1 is electrically connected to an input terminal 314 via an input port P1. The other end of the first central electrode L1 is electrically connected to an output terminal 315 via an output port P2.

One end of a second central electrode L2 is electrically connected to the output terminal 315 via the output port P2. The other end of the second central electrode L2 is grounded via a ground port P3. A parallel RC circuit including a matching capacitor C1 and a resistor R is electrically connected between the input port P1 and the output port P2. A matching capacitor C2 is electrically connected between the output port P2 and the ground port P3.

The first central electrode L1 and the matching capacitor C1 define a first LC parallel resonant circuit and the second central electrode L2 and the matching capacitor C2 define a second LC parallel resonant circuit. In the above-described circuit configuration, since the first LC parallel resonant circuit between the input port P1 and the output port P2 does not resonate and only the second LC parallel resonant circuit resonates when a signal is transmitted from the input port P1 to the output port P2, the insertion loss is reduced.

The insertion loss and isolation are typically important among electrical characteristics required of the non-reciprocal circuit device. Requirements for the insertion loss and the isolation depend on a communication system, the configuration of a communication circuit, and/or functions added to a mobile phone. A comparison between the requirements and actual characteristics can produce a situation in which the requirements are sufficiently met in terms of the insertion loss but are not met in terms of the isolation, or a situation in which the requirements are sufficiently met in terms of the isolation but are not met in terms of the insertion loss.

If the inductance of the second central electrode L2 is increased in the two-port isolator 301 in the related art, the forward transmission characteristics in a broader band, having a reduced insertion loss, are yielded although the bandwidth of the isolation characteristics is narrowed.

However, if the inductance of the central electrode L2 is set so as to exceed a predetermined value by any of the following three methods, problems are caused and it becomes impossible to flexibly adjust the insertion loss characteristics.

(1) If the central electrode L2 is lengthened, the ferrite is enlarged in accordance with the increasing length of the central electrode L2. As a result, the product cannot be reduced in size.

(2) If the line width of the central electrode L2 is narrowed, the equivalent series resistance of the central electrode L2 is increased and the Q factor of the central electrode (inductor) L2 is decreased. As a result, the insertion loss is increased.

(3) When the central electrode L2 is wound around the ferrite, the interval of the central electrodes is shortened as the number of wind ings thereof is increased and, thus, short circuit frequently occurs. If the windings of the central electrode are sufficiently spaced such that the short circuit does not occur, the product cannot be reduced in size.

In addition, if the inductance of the central electrode L2 is set so as to exceed the predetermined value, the capacitance of the capacitor C2 with which the central electrode L2 defines the parallel resonant circuit is substantially reduced in a relatively high-frequency system, such as Personal Communication Services (PCS) (having a center frequency of 1,880 MHz) or Wideband Code Division Multiple Access (W-CDMA) (having a center frequency of 1,950 MHz). Accordingly, it is difficult to measure and adjust the capacitance and, therefore, it is not possible to mass-produce the product. In addition, there are situations in which the stray capacitance is greater than the required capacitance, and it is not possible to actuate the isolator 301 at a desired frequency. Furthermore, there are also situations in which the electrical length of the central electrode L2 is greater than $\lambda/4$ and the central electrode L2 does not function as an inductor. In this situation, the parallel resonant circuit cannot be provided.

SUMMARY OF THE INVENTION

To overcome the problems described above, preferred embodiments of the present invention provide a compact two-port non-reciprocal circuit device having a reduced insertion loss, capable of flexibly adjusting the insertion loss characteristics in accordance with the requirements, and provide a communication apparatus including the two-port non-reciprocal circuit device.

A two-port non-reciprocal circuit device according to a preferred embodiment of the present invention includes a permanent magnet, a ferrite to which a direct-current magnetic field is applied from the permanent magnet, a first central electrode provided on the ferrite, one end of the first central electrode being electrically connected to an input port, the other end thereof being electrically connected to an output port, a second central electrode intersecting with the first central electrode and being electrically insulated from the first central electrode on the ferrite, one end of the second central electrode being electrically connected to the output port, the other end thereof being electrically connected to a ground port, a first capacitor electrically connected between the input port and the output port, a resistor electrically connected between the input port and the output port, a second capacitor electrically connected between the output port and the ground port, an input terminal, and an output terminal. A third capacitor is connected between the input port and the input terminal or between the output port and the output terminal or a third capacitor is connected between the input port and the input terminal and another third capacitor is connected between the output port and the output terminal, and a capacitor element is electrically connected between the input terminal and the output terminal.

The first, second, and the third capacitors, the capacitor element, the resistor, the input terminal, and the output terminal are disposed inside or on a multilayer substrate and sandwiched between electrode films, and the permanent magnet, the ferrite, a yoke defining the first and second central electrodes, and a magnetic circuit are provided on the multilayer substrate. With this structure, it is possible to reduce the size and cost of the non-reciprocal circuit device.

The use of a chip capacitor as the capacitor element enables desired characteristics to be achieved at a low cost.

A communication apparatus according to another preferred embodiment of the present invention includes the two-port non-reciprocal circuit device having the above-described unique features. The insertion loss characteristics are improved in a broader bandwidth.

According to preferred embodiments of the present invention, the third capacitor is connected between the input port and the input terminal or between the output port and the output terminal or a third capacitor is connected between the input port and the input terminal and another third capacitor is connected between the output port and the output terminal, and the capacitor element is electrically connected between the input terminal and the output terminal. Accordingly, forward transmission characteristics in a broader bandwidth and having a small insertion loss are provided. Consequently, it is possible to provide the two-port non-reciprocal circuit device that is capable of flexibly adjusting the insertion loss characteristics in accordance with the requirements, and to provide the communication apparatus including the two-port non-reciprocal circuit device.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of a two-port non-reciprocal circuit device and a communication apparatus according to the present invention will be described with reference to the attached drawings.

Typical examples of the electrical circuits of two-port non-reciprocal circuit devices according to preferred embodiments of the present invention are shown in FIGS. 1 to 5. These two-port non-reciprocal circuit devices are preferably lumped constant isolators.

Figure 1:
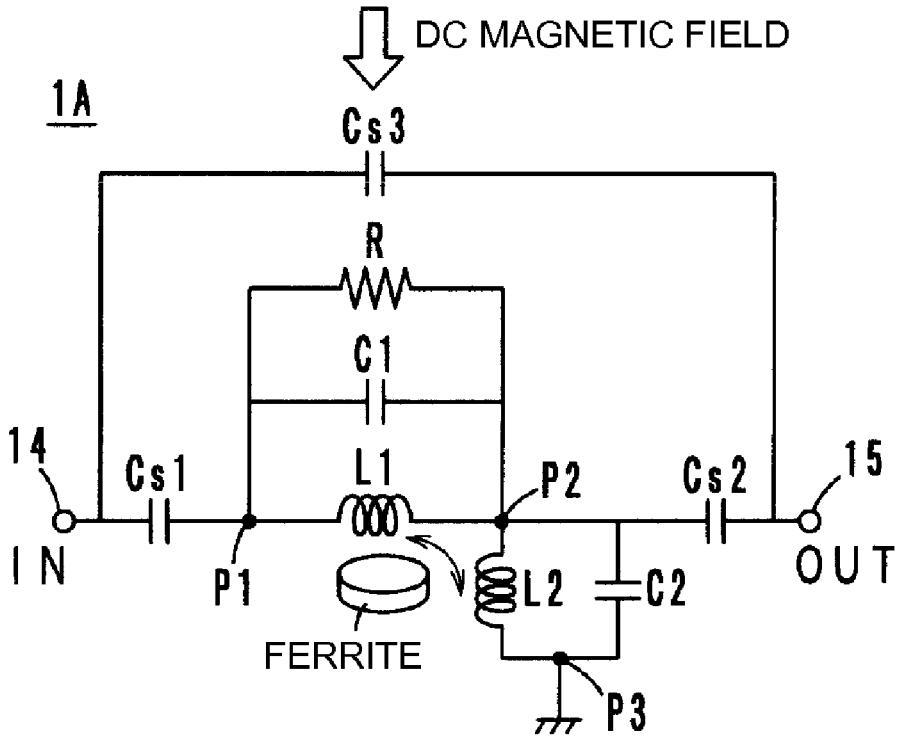
FIG. 1 is an electrical equivalent circuit diagram showing a preferred embodiment of a two-port non-reciprocal circuit device according to the present invention.

In a two-port isolator 1A shown in FIG. 1, one end of a first central electrode L1 is electrically connected to an input port P1 and the other end of the first central electrode L1 is electrically connected to an output port P2. One end of a second central electrode L2 is electrically connected to the output port P2 and the other end of the second central electrode L2 is electrically connected to a ground port P3. A resonant capacitor C1 and a terminating resistor R are electrically connected in parallel between the input port P1 and the output port P2. A resonant capacitor C2 is electrically connected between the output port P2 and the ground port P3. A matching capacitor Cs1 for impedance matching is electrically connected between the input port P1 and an input terminal 14, and a matching capacitor Cs2 for impedance matching is electrically connected between the output port P2 and an output terminal 15. A coupling capacitor element Cs3 is electrically connected between the input terminal 14 and the output terminal 15.

The first central electrode L1 and the resonant capacitor C1 define a parallel resonant circuit between the input port P1 and the output port P2. The second central electrode L2 and the resonant capacitor C2 define a parallel resonant circuit between the output port P2 and the ground.

In the isolator 1A before the coupling capacitor element Cs3 is connected thereto, the phase of a transmission signal through the output terminal 15 advances with respect to the phase of the transmission signal through the input terminal 14 in forward transmission, while the phase of the transmission signal through the input terminal 14 advances with respect to the phase of the transmission signal through the output terminal 15 in reverse transmission. In addition, the presence of the coupling capacitor element Cs3 advances the phase of the transmission signal both in the forward transmission and in the reverse transmission. Accordingly, in the isolator 1A after the coupling capacitor element Cs3 is connected between the input terminal 14 and the output terminal 15, a signal transmitted by the action of the magnetic coupling between the central electrodes L1 and L2 is reinforced by a signal transmitted through the coupling capacitor element Cs3 in the forward transmission to strengthen the entire transmission signal. In other words, the forward transmission characteristics in a broader band and having a smaller insertion loss are provided. This effect increases as the electrostatic capacitance of the coupling capacitor element Cs3 increases.

Consequently, since lengthening of the second central electrode L2 and increasing the inductance of the second central electrode L2 are not required, the size of the isolator 1A can be reduced. In addition, since it is not necessary to increase the inductance of the second central electrode L2, it is not necessary to reduce the size of the isolator 1A to such an extent that the capacitance of the resonant capacitor C2 cannot be measured or adjusted. Thus, the isolator 1A is suitable for use in a relatively high-frequency system, such as PCS (having a center frequency of 1,880 MHz) or W-CDMA (having a center frequency of 1,950 MHz).

The forward transmission characteristics in a broader band, having a reduced insertion loss, are provided although the bandwidth of the isolation characteristics is narrowed. This is because a reverse signal transmitted by an action of the magnetic coupling between the central electrodes L1 and L2 is reinforced by a reverse signal transmitted through the coupling capacitor element Cs3 in the reverse transmission, as in the forward transmission, to strengthen the entire reverse signal. However, recent requirements for the isolator are more likely to treat the insertion loss as more important than the isolation, and the isolation characteristics in a narrower band often present no problems.

Figure 2:
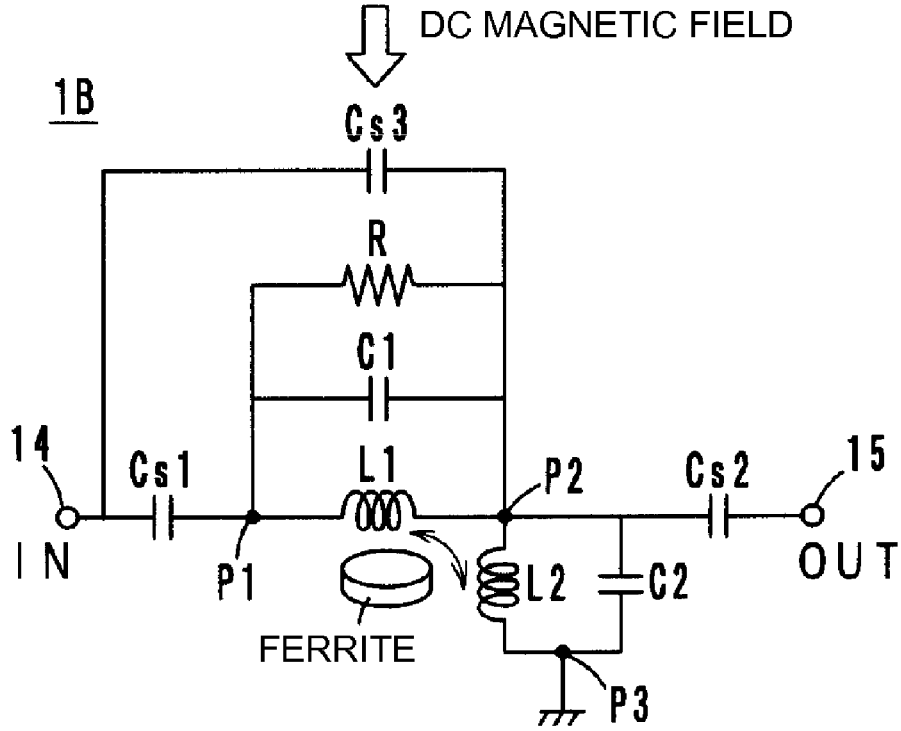
FIG. 2 is an equivalent circuit diagram showing another preferred embodiment of the two-port non-reciprocal circuit device according to the present invention.

In a two-port isolator 1B shown in FIG. 2, the coupling capacitor element Cs3 is electrically connected between the input terminal 14 and the output port P2. In a two-port isolator 1C shown in FIG. 3, the coupling capacitor element Cs3 is electrically connected between the input port P1 and the output terminal 15. In a two-port isolator 1D shown in FIG. 4, the coupling capacitor element Cs3 is electrically connected between the input terminal 14 and the output port P2, and the impedance matching capacitor Cs2 is not connected between the output port P2 and the output terminal 15. In a two-port isolator 1E shown in FIG. 5, the coupling capacitor element Cs3 is electrically connected between the input port P1 and the output terminal 15, and the impedance matching capacitor Cs1 is not connected between the input terminal 14 and the input port P1.

The features of the isolators 1A to 1E will be described in detail with reference to Table 1. Table 1 shows the results of a comparison between the isolators 1A to 1E with the insertion loss being set to a certain value. The values of the insertion loss and the isolation in Table 1 are the worst values (however, meeting required standard values) measured in a bandwidth from 1,710 MHz to 1,910 MHz.

Figure 3:
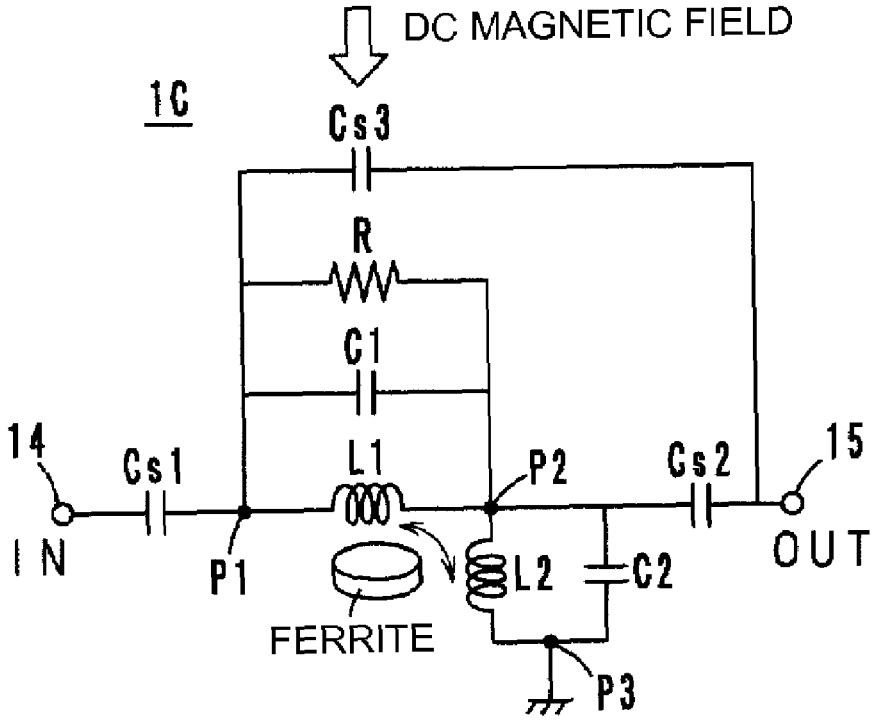
FIG. 3 is an equivalent circuit diagram showing yet another preferred embodiment of the two-port non-reciprocal circuit device according to the present invention.

The capacitances of the impedance matching capacitors Cs1 and Cs2 in the isolators 1B and 1C in FIGS. 2 and 3 tend to be less than those of the impedance matching capacitors Cs1 and Cs2 in the isolator 1A in FIG. 1. Since a smaller capacitance generally enables the areas of the electrodes to be decreased, the size of the product can be reduced. The electrical characteristics of the isolator 1B in FIG. 2 has no superiority over those of the isolator 1C in FIG. 3, and the capacitance of the isolator 1B in FIG. 2 does not differ from that of the isolator 1C in FIG. 3.

The choice between the isolators 1A to 1C in FIGS. 1 to 3 may be based on the arrangement of the electrodes. For example, the isolator 1A in FIG. 1 is effective when the electrode of the input terminal is close to that of the output terminal. The isolator 1B in FIG. 2 is effective when the electrode of the input terminal is close to the electrode of the output port and it is desirable to shorten the capacitor electrode on which the coupling capacitor element Cs3 is provided. The isolator 1C in FIG. 3 is effective when the electrode of the input port is close to the electrode of the output terminal.

Figure 4:
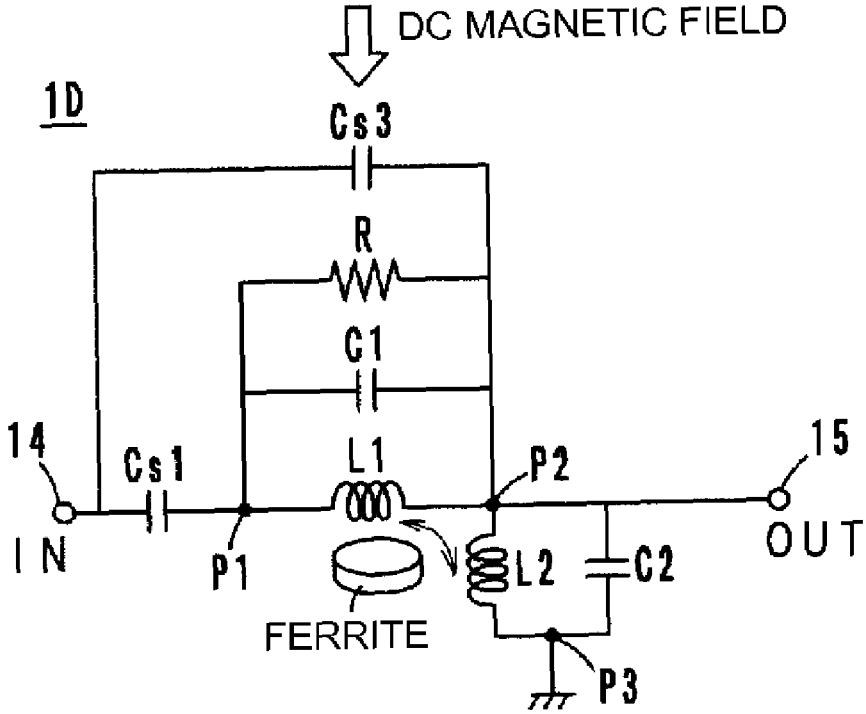
FIG. 4 is an equivalent circuit diagram showing another preferred embodiment of the two-port non-reciprocal circuit device according to the present invention.
Figure 5:
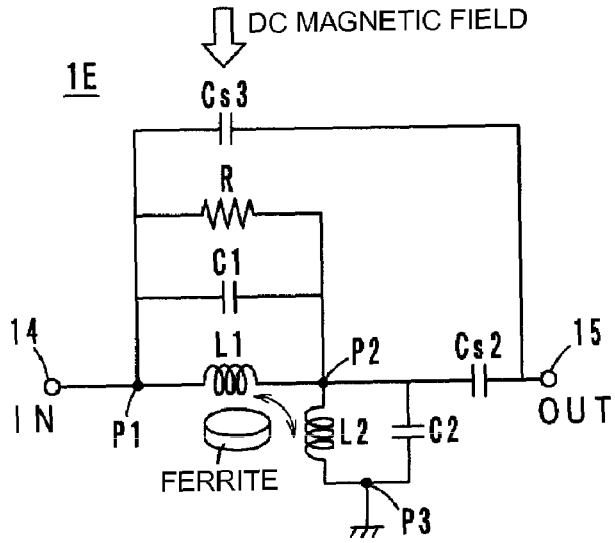
FIG. 5 is an equivalent circuit diagram showing still another preferred embodiment of the two-port non-reciprocal circuit device according to the present invention.

The isolators 1D and 1E shown in FIGS. 4 and 5, respectively, have isolation values of about 7.0 dB to about 7.1 dB, which are about 1 dB less than those of the isolators 1A to 1C in FIGS. 1 to 3. This is attributed to the fact that the number of windings of the central electrode L1 or L2 is decreased, such that the impedance of an input return loss S11 or an output return loss S22 becomes 50+j0 Ω without the impedance matching capacitor Cs1 or Cs2 being connected to reduce the coupling coefficient between the central electrodes L1 and L2.

The capacitance of the resonant capacitor C2 in the isolator 1D in FIG. 4 is likely to be greater than the capacitances of the resonant capacitors C2 in the remaining isolators. This is because the inductance of the central electrode L2 is decreased such that the impedance of the output return loss S22 becomes 50+j0 Ω without the impedance matching capacitor Cs2 being connected. In addition, in order to prevent the insertion loss from being increased due to a reduced inductance of the central electrode L2, the capacitance of the coupling capacitor element Cs3 is increased. Furthermore, the capacitance of the impedance matching capacitor Cs1 is likely to be greater than the capacitances of the impedance matching capacitors Cs1 in the remaining isolators. The isolator 1D in FIG. 4 is effective when the inductance of the central electrode L2 cannot be increased due to a physical constraint, such as the number of windings of the central electrode L2 cannot be increased.

The capacitance of the resonant capacitor C1 in the isolator 1E in FIG. 5 is likely to be greater than the capacitances of the resonant capacitors C1 in the remaining isolators. This is because the inductance of the central electrode L1 is decreased such that the impedance of the

TABLE 1

| | Circuit constant | | | | | | | | Insertion | |
|---|---|---|---|---|---|---|---|---|---|---|
| Circuit | C1 (pF) | C2 (pF) | Cs1 (pF) | Cs2 (pF) | Cs3 (pF) | L1 (nH) | L2 (nH) | R (Ω) | loss (dB) | Isolation (dB) |
| FIG. 1 | 6.0 | 1.0 | 5.0 | 8.0 | 0.5 | 1.3 | 7.8 | 100 | 0.43 | 8.1 |
| FIG. 2 | 6.0 | 1.0 | 4.0 | 6.0 | 0.5 | 1.3 | 7.8 | 100 | ↑ | 8.3 |
| FIG. 3 | 6.0 | 1.0 | 4.0 | 6.0 | 0.5 | 1.3 | 7.8 | 100 | ↑ | 8.3 |
| FIG. 4 | 6.0 | 2.0 | 8.0 | — | 1.5 | 1.3 | 3.9 | 100 | ↑ | 7.0 |
| FIG. 5 | 10.0 | 1.0 | — | 10.0 | 0.3 | 0.8 | 7.8 | 100 | ↑ | 7.1 |

In the comparison between the isolation characteristics with the insertion loss being set to a certain value (0.43 dB), the values of isolation of the isolators 1A to 1C shown in FIGS. 1 to 3 range from about 8.1 dB to about 8.3 dB, which do not greatly differ from each other. This is attributed to the fact that setting the insertion loss to a certain value is equivalent to making the total amount of a forward signal transmitted by the magnetic coupling between the first central electrodes L1 and L2 and a forward signal transmitted through the coupling capacitor element Cs3 constant and the reverse signal is strengthened in proportion to the forward signal.

input return loss S11 becomes 50+j0 Ω without the impedance matching capacitor Cs1 being connected. In addition, since the inductance of the central electrode L1 is reduced and the insertion loss is initially reduced, the coupling capacitor element Cs3 has a low capacitance. Furthermore, the capacitance of the impedance matching capacitor Cs2 is likely to be greater than the capacitances of the impedance matching capacitors Cs2 in the remaining isolators. The isolator 1E in FIG. 5 is effective when the inductance of the central electrode L1 cannot be increased due to a physical constraint, such as the number of windings of the central electrode L1 that cannot be increased.

Since the inductances of the central electrodes L1 and L2 and the capacitances of the resonant capacitors C1 and C2 etc., shown in Table 1, depend on parameters including the mutual inductance or the coupling coefficient between the central electrodes L1 and L2, the angle between the central electrodes L1 and L2, the material constant of the ferrite, and the strength of the direct-current (DC) magnetic field, it is difficult to represent the inductances and the capacitances using simple computational expressions. Accordingly, the optimal inductances and capacitances were set by a method described below. The isolator 1B in FIG. 2 will be described in the following description.

First, the inductances of the central electrodes L1 and L2 and the capacitances of the resonant capacitors C1 and C2 are set to optimal values in the isolator 1B in FIG. 2 before the impedance matching capacitors Cs1 and Cs2 and the coupling capacitor element Cs3 are connected.

The inductances of the central electrodes L1 and L2 and the capacitances of the resonant capacitors C1 and C2 are determined according to the following relational expressions such that a parallel resonance is produced at a desired center frequency f(0).

$$f(0)=1/(2\pi\cdot\sqrt{(L1\cdot C1)})$$

$$f(0)=1/(2\pi\cdot\sqrt{(L2\cdot C2)})$$

The ratio between the inductance of the central electrode L1 and the capacitance of the resonant capacitor C1 and the ratio between the inductance of the central electrode L2 and the capacitance of the resonant capacitor C2 are determined by experimentation so as to yield optimal characteristics. Here, the line lengths of the central electrodes L1 and L2 are set such the following relationship is established between the line lengths of the central electrodes L1 and L2 and the electrical length of λ/4.

Line length of central electrode L1 (L2)$<<c/(4\cdot f(0)\cdot\sqrt{\epsilon r})$ where c denotes the velocity of light and εr denotes the relative permittivity of the ferrite.

Specifically, the inductances of the central electrodes L1 and L2 and the capacitances of the resonant capacitors C1 and C2 are set such that the real parts of the input and output impedances have a predetermined value (when the impedance of an external circuit is approximately equal to 50 Ω, the predetermined value is approximately equal to 50 Ω in order to achieve the matching with the impedance of the external circuit). Here, the line lengths of the central electrodes L1 and L2 are preferably set to a value less than about λ/4. In the isolator 1B in FIG. 2, the inductance of the central electrode L1 was set to about 1.3 nH, the inductance of the central electrode L2 was set to about 7.8 nH, the capacitance of the resonant capacitor C2 was set to about 6 pF, and the capacitance of the resonant capacitor C2 was set to about 1 pF in the manner described above. The input impedance was equal to about 50+j22 Ω and the output impedance was equal to about 50+j15 Ω.

The resistance of the terminating resistor R was set to about 100 Ω by experimentation so as to yield a maximum isolation bandwidth.

Next, the capacitances of the matching capacitors Cs1 and Cs2 are calculated according to the following computational expression, on the assumption that the input and output impedances of the isolator 1B before the matching capacitors Cs1 and Cs2 are connected are equal to 50+jX Ω. Specifically, the capacitances of the matching capacitors Cs1 and Cs2 are set such that the imaginary parts X is approximately equal to zero.

$$Cs1,\ Cs2=1/(2\pi\cdot f(0)\cdot X)$$

The capacitance of the matching capacitor Cs1 was set to about 4 pF and the capacitance of the matching capacitor Cs2 was set to about 6 pF in the manner described above in the isolator 1B in FIG. 2. The connection of the matching capacitors Cs1 and the Cs2 does not change the capacitances of the resonant capacitors C1 and C2.

Figure 6:
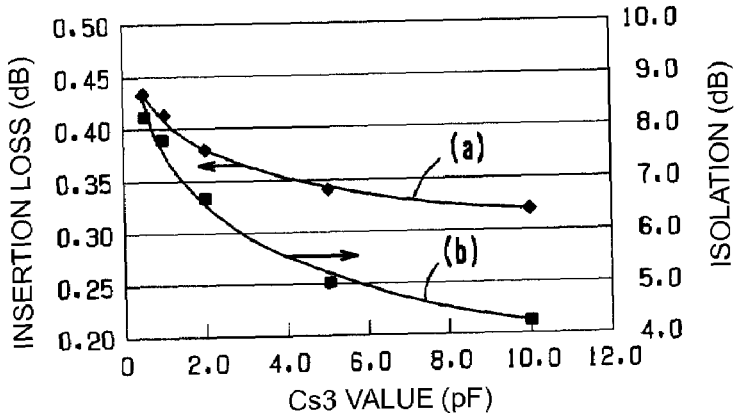
FIG. 6 is a graph showing the relationship between the capacitance of a coupling capacitor element Cs3 and the insertion loss and between the capacitance of the coupling capacitor element Cs3 and the isolation.
Figure 7:
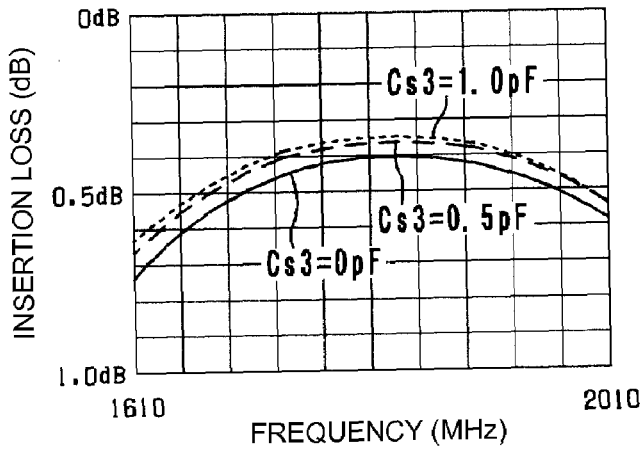
FIG. 7 is a graph showing insertion loss characteristics.
Figure 8:
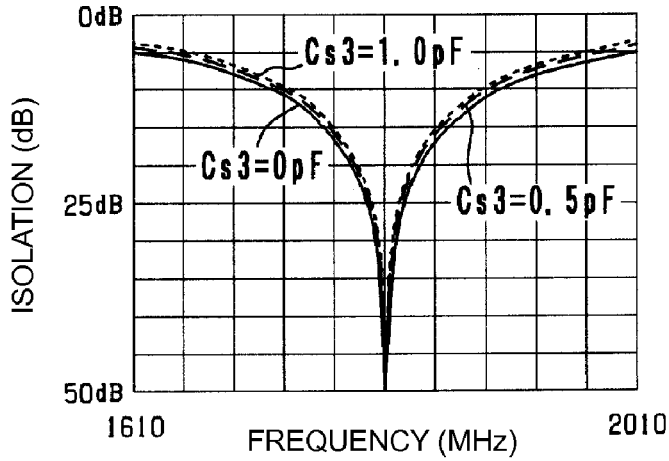
FIG. 8 is a graph showing isolation characteristics.

Next, the capacitance of the coupling capacitor element Cs3 is calculated. As shown in FIGS. 6 to 8 and Table 2, the insertion loss is decreased but the isolation is degraded with the increased capacitance of the coupling capacitor element Cs3.

TABLE 2

| | | Cs3 (pF) | | | | | |
|---|---|---|---|---|---|---|---|
| Item | Unit | None | 0.5 | 1.0 | 2.0 | 5.0 | 10.0 |
| Insertion loss | (dB) | 0.48 | 0.43 | 0.41 | 0.38 | 0.34 | 0.32 |
| Isolation | (dB) | 9.1 | 8.3 | 7.8 | 6.7 | 5.0 | 4.3 |

Accordingly, the capacitance of the coupling capacitor element Cs3 is set such that the insertion loss and the isolation are maintained within the requirements. FIG. 6 is a graph showing the relationship (a) between the capacitance of the coupling capacitor element Cs3 and the insertion loss and the relationship, and (b) between the capacitance of the coupling capacitor element Cs3 and the isolation. FIGS. 7 and 8 are graphs showing the insertion loss characteristics and the isolation characteristics, respectively. The values of the insertion loss and the isolation in Table 2 are the worst values (however, meeting required standard values) measured in a bandwidth from 1,710 MHz to 1,910 MHz. The capacitance of the coupling capacitor element Cs3 in the isolator 1B in FIG. 2 was set to about 0.5 pF on the basis of FIGS. 6 to 8 and Table 2.

When only the matching capacitor Cs1 is provided (the matching capacitor Cs2 is not provided), as in the isolator 1D in FIG. 4, the inductance of the central electrode L1 is high (the inductance of the central electrode L2 is low) and, therefore, the isolation characteristics are improved in the trade-off relationship between the insertion loss and the isolation. The output impedance is set to about 50+j0 Ω by setting the inductance of the central electrode L2 to an appropriate value by not using a circuit configuration in which the number of windings of the central electrode L2 is increased to increase the inductance thereof.

In contrast, when only the matching capacitor Cs2 is provided (the matching capacitor Cs1 is not provided), as in the isolator 1E in FIG. 5, the inductance of the central electrode L2 is high (the inductance of the central electrode L1 is low) and, therefore, the insertion loss characteristics are improved in the trade-off relationship between the insertion loss and the isolation. The input impedance is set to about 50+j0 Ω by setting the inductance of the central electrode L1 to an appropriate value by not adopting a circuit configuration in which the number of windings of the central electrode L1 is increased to increase the inductance thereof.

Figure 9:
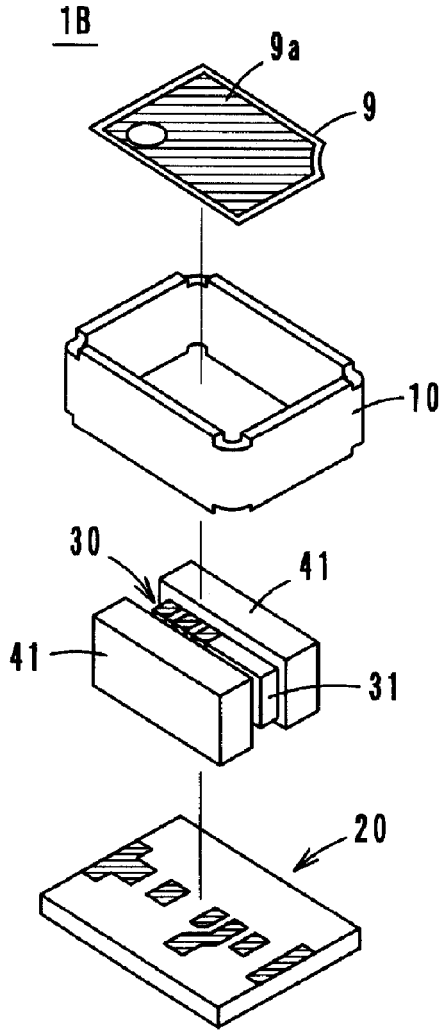
FIG. 9 is an exploded perspective view showing a preferred embodiment of the two-port non-reciprocal circuit device according to the present invention.

FIG. 9 is an exploded perspective view showing an example of the two-port isolator 1B shown in FIG. 2. The two-port isolator 1B includes a metallic yoke 10, a multilayer substrate 20, a central electrode assembly 30 including a ferrite 31, permanent magnets 41, and a resin substrate 9. A DC magnetic field is applied from the permanent magnets 41 to the ferrite 31. An electrode 9*a* is provided on the surface of the resin substrate 9.

The resin substrate 9 prevents foreign objects from entering the isolator 1B. The electrode 9*a* functions as a high-frequency shield and can be used to suppress an external electromagnetic effect.

The yoke 10 is made of a ferromagnetic material, such as soft iron. Silver plating is applied to the yoke 10. The yoke 10 is shaped like a frame surrounding the central electrode assembly 30 and the permanent magnets 41 on the multilayer substrate 20.

Figure 10:
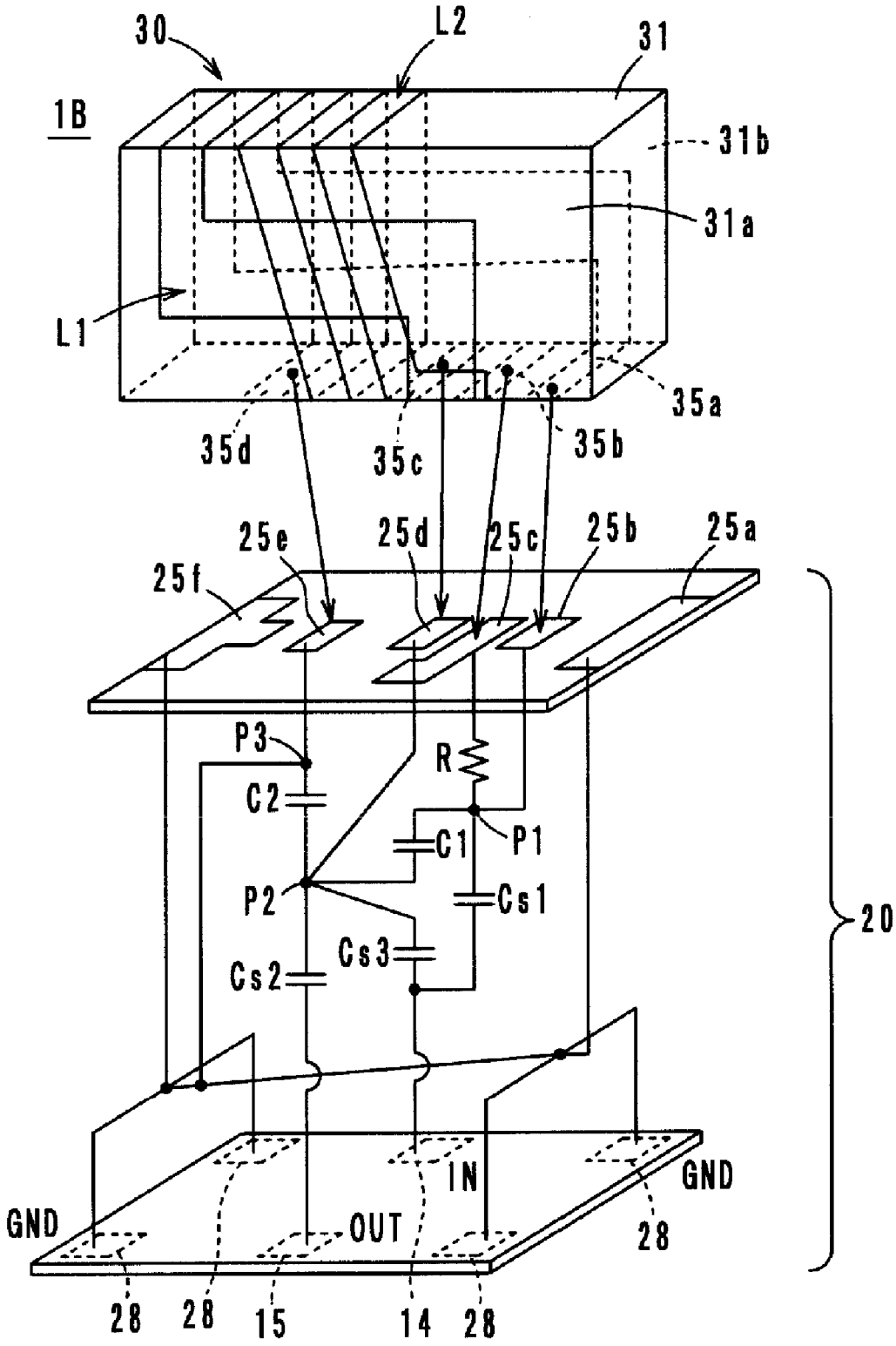
FIG. 10 is an exploded perspective view showing the main part of the two-port non-reciprocal circuit device in FIG. 9.
Figure 11A:
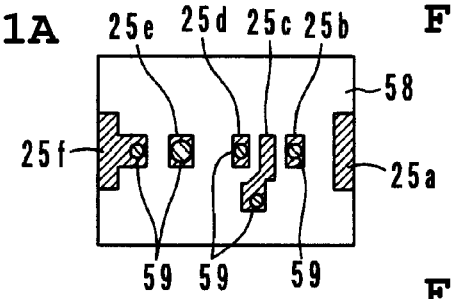
FIGS. 11A to 11I includes exploded plan views of a multilayer substrate shown in FIG. 10.
Figure 11B:
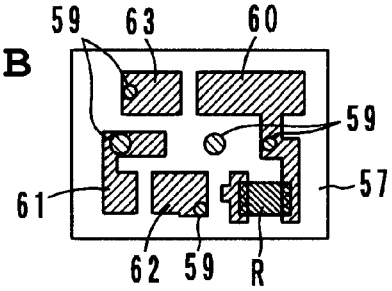
Figure 11C:
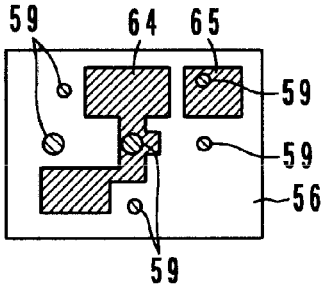
Figure 11D:
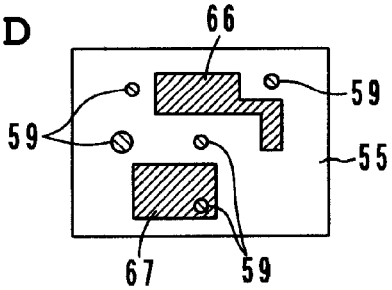
Figure 11E:
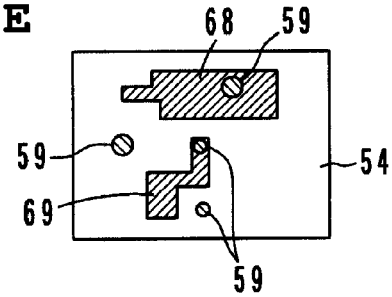
Figure 11F:
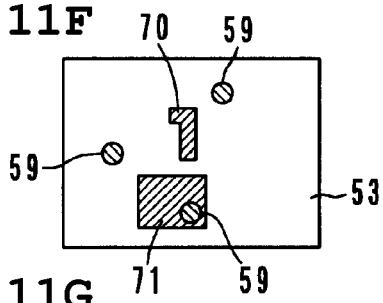
Figure 11G:
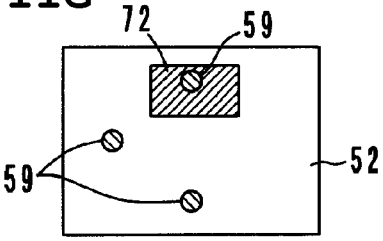
Figure 11H:
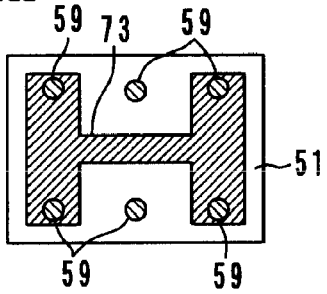
Figure 11I:
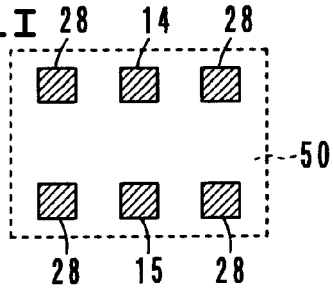

The central electrode assembly 30 includes the first central electrode L1 and the second central electrode L2 provided on a primary surface 31*a* and a primary surface 31*b* of the microwave ferrite 31, respectively, as shown in FIG. 10. The first central electrode L1 is electrically insulated from the second central electrode L2. The ferrite 31 is a rectangular prism including the first primary surface 31*a* and the second primary surface 31*b* that are substantially parallel to each other. The first primary surface 31*a* and the second primary surface 31*b* are arranged substantially perpendicular to the multilayer substrate 20.

The permanent magnets 41 are arranged on the multilayer substrate 20 so as to apply the magnetic field to the primary surfaces 31*a* and 31*b* of the ferrite 31 in a direction substantially perpendicular thereto.

As shown in FIG. 10, the ferrite 31 is wrapped from the first primary surface 31*a* to the second primary surface 31*b* in the first central electrode L1. The second central electrode L2 includes two turns that are helically wound around the ferrite 31. The second central electrode L2 intersects with the first central electrode L1 on the first primary surface 31*a* and the second primary surface 31*b* of the ferrite 31. The angle between the central electrodes L1 and L2 is set to a desired value to adjust the input impedance and the insertion loss.

The multilayer substrate 20 is formed by layering multiple dielectric sheets having predetermined electrodes provided thereon and sintering the multiple dielectric sheets. The multilayer substrate 20 includes the resonant capacitors C1 and C2, the terminating resistor R, the impedance matching capacitors Cs1 and Cs2, and the coupling capacitor element Cs3, as shown in FIG. 10. Electrodes 25*a* and 25*f* for connection of the yoke and connection electrodes 25*b* to 25*e* for the central electrodes are provided on the upper surface of the multilayer substrate 20. Electrodes 14 and 15 for the input and output terminals and electrodes 28 for the ground terminals are provided on the lower surface of the multilayer substrate 20.

The multilayer substrate 20 is soldered to and integrated with the yoke 10 via the electrodes 25*a* and 25*f* for connection of the yoke. Various electrodes 35*a* to 35*d* for connection on the side surfaces of the ferrite 31 are soldered to the connection electrodes 25*b* to 25*e* for the central electrodes on the multilayer substrate 20 to integrate the central electrode assembly 30 with the multilayer substrate 20. The permanent magnets 41, 41 are integrated with the inside walls of the yoke 10, the upper surface of the multilayer substrate 20, or the primary surfaces of the ferrite with adhesive.

The multilayer substrate 20 is manufactured in the following manner. As shown in FIGS. 11A to 11I, the multilayer substrate 20 includes a dielectric sheet 58 having the electrodes 25*a* and 25*f* for connection of the yoke and the connection electrodes 25*b* to 25*e* for the central electrodes provided thereon, a dielectric sheet 57 having capacitor electrodes 60 to 63 and the resistor R provided thereon, dielectric sheets 56 to 52 having the capacitor electrodes 64 to 72 provided thereon, a dielectric sheet 51 having a ground electrode 73 provided thereon, the electrodes for the input terminal 14 and the output terminal 15, the electrodes 28 for the ground terminals, and so on. The dielectric sheets 51 to 58 are preferably made of a low-temperature sintering dielectric material including $Al_2O_3$ as the main component and including at least one of $SiO_2$, SrO, CaO, PbO, $Na_2O$, $K_2O$, MgO, BaO, $CeO_2$, and $B_2O_3$ as the minor components.

In addition, anti-shrinkage sheets 50 are manufactured. The anti-shrinkage sheets 50 do not fire under the firing conditions (particularly, at a temperature below about 1,000° C.) of the multilayer substrate 20 to suppress firing and shrinkage of the multilayer substrate 20 in the direction of the plane surface of the substrate (X-Y direction). The anti-shrinkage sheets 50 are preferably made of a mixture of alumina powder and stabilized zirconia powder.

The electrodes 14, 15, 28, 25*a* to 25*f*, and 60 to 73 are preferably formed on the dielectric sheets 51 to 58 by pattern printing or other suitable method. The electrodes 14 to 73 are made of, for example, Ag, Cu, or Ag—Pd, having a lower resistivity and capable of being fired simultaneously with the dielectric sheets 51 to 58.

The resistor R is formed on the dielectric sheet 57 by the pattern printing or other suitable method. The resistor R is made of, for example, cermet or ruthenium.

Via holes 59 are formed by making openings for the via holes in advance in the dielectric sheets 51 to 58 by laser-beam machining, punching, or other suitable and, then, filling the apertures for the via holes with conductive paste.

The capacitor electrodes 60, 64, and 66 define the resonant capacitor C1 with the dielectric sheets 56 and 57 being sandwiched therebetween. The capacitor electrodes 61 and 64 define the resonant capacitor C2 with the dielectric sheet 57 being sandwiched therebetween. The capacitor electrodes 60, 65, 66, and 68 define the matching capacitor Cs1 with the dielectric sheets 57 and 55 being sandwiched therebetween. The capacitor electrodes 62, 64, 67, 69, and 71 define the matching capacitor Cs2 with the dielectric sheets 54 to 57 being sandwiched therebetween. The capacitor electrodes 63, 64, 68, 70, and 72 define the coupling capacitor element Cs3 with the dielectric sheets 53, 54, and 57 being sandwiched therebetween. These capacitors C1 to Cs3 and the resistor R define the electrical circuit as shown in FIG. 10, along with the via holes 59, inside the multilayer substrate 20.

The sheets 51 to 58 are sequentially layered and the layered sheets 51 to 58 are fired while being sandwiched between the anti-shrinkage sheets to provide a sintered body. Then, the anti-shrinkage sheets 50 that are not sintered are removed by ultrasonic cleaning or wet honing to produce the multilayer substrate 20 shown in FIG. 10. The produced multilayer substrate 20 cannot have desired capacitances and resistance due to pattern or layering misalignment. In such a case, a laser or a cutting tool is used to trim the capacitor electrodes 60, 61, 62, and 63 and the resistor R in order to adjust the capacitances and resistance to desired values.

Since the multiple resonant capacitors C1 to Cs3 and the terminating resistor R are integrally formed in the multilayer substrate 20 in the two-port isolator 1B having the above structure, it is possible to reduce the size and cost of the isolator 1B.

Figure 12:
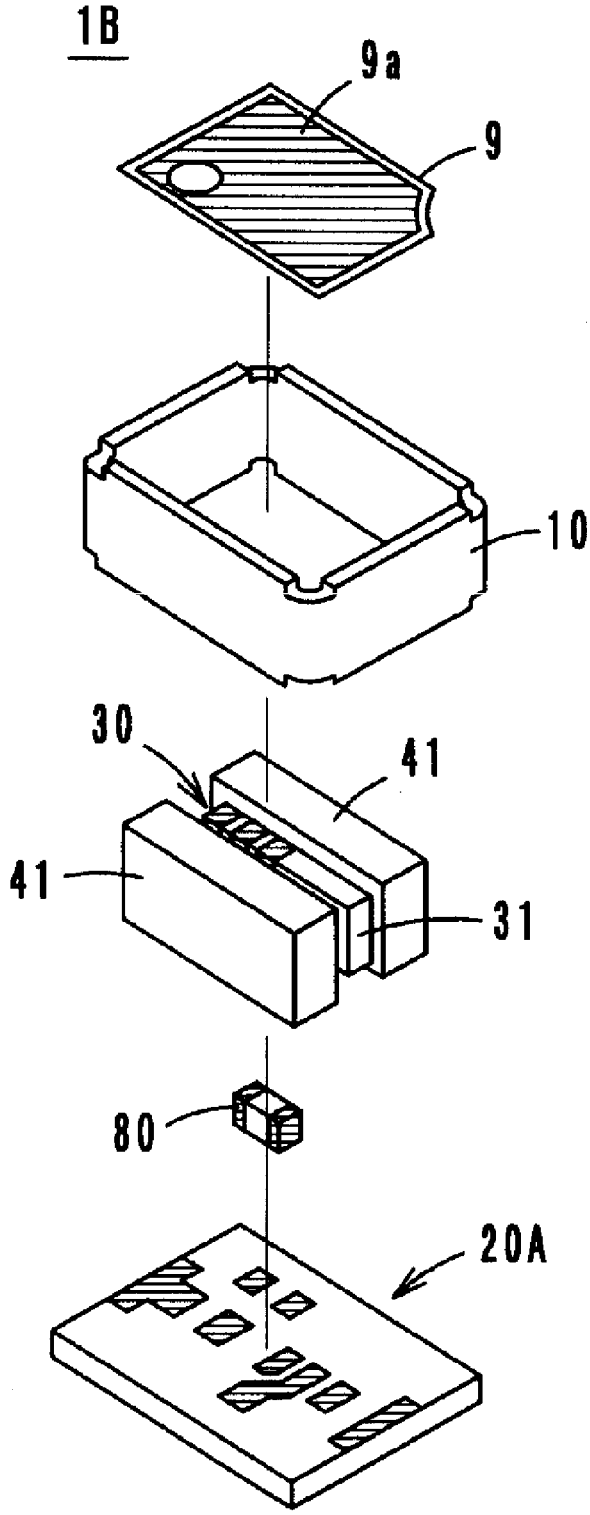
FIG. 12 is an exploded perspective view showing a modification of the two-port non-reciprocal circuit device in FIG. 9.
Figure 13A:
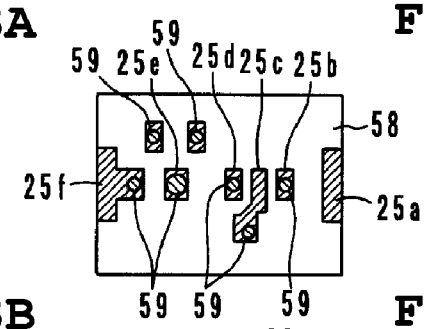
FIGS. 13A to 13I includes exploded plan views of a multilayer substrate shown in FIG. 12.
Figure 13B:
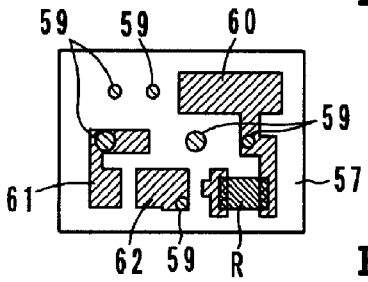
Figure 13C:
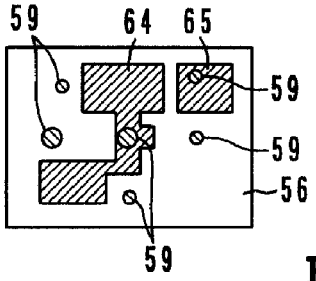
Figure 13D:
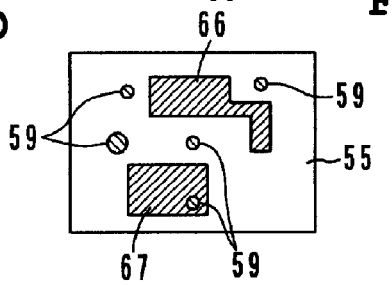
Figure 13E:
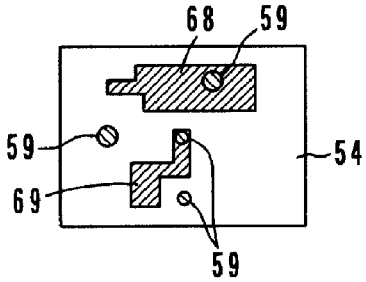
Figure 13F:
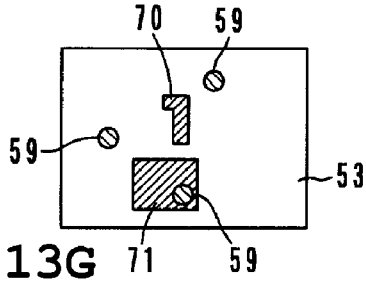
Figure 13G:
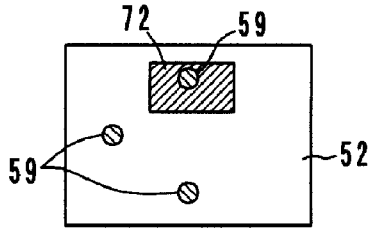
Figure 13H:
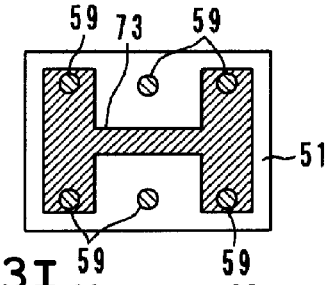
Figure 13I:
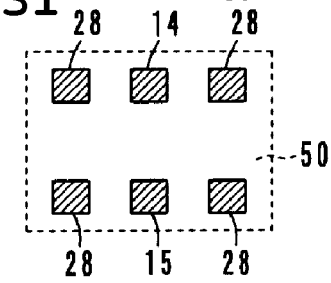

The two-port isolator 1B shown in FIG. 12 has a chip capacitor 80 mounted on a multilayer substrate 20A, instead of the coupling capacitor element Cs3 formed in the multilayer substrate 20. An exploded perspective view of the multilayer substrate 20A is shown in FIGS. 13A to 13I.

Selecting the chip capacitor 80 having an appropriate capacitance in the above structure enables the capacitance of the coupling capacitor element Cs3 to be easily varied to provide isolators having various forward transmission characteristics. Since it is not necessary to redesign and remanufacture the multilayer substrate 20A and the central electrodes L1 and L2, mass production in a short time is achieved at a low cost.

Figure 14:
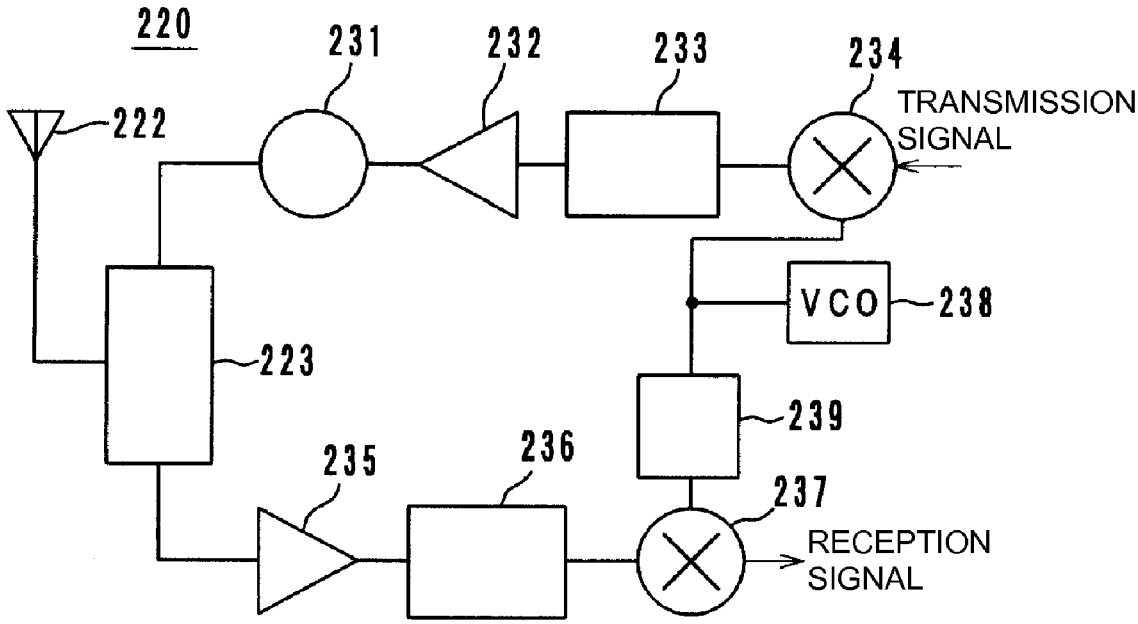
FIG. 14 is a block diagram of the electrical circuit showing a preferred embodiment of a communication apparatus according to the present invention.
Figure 15:
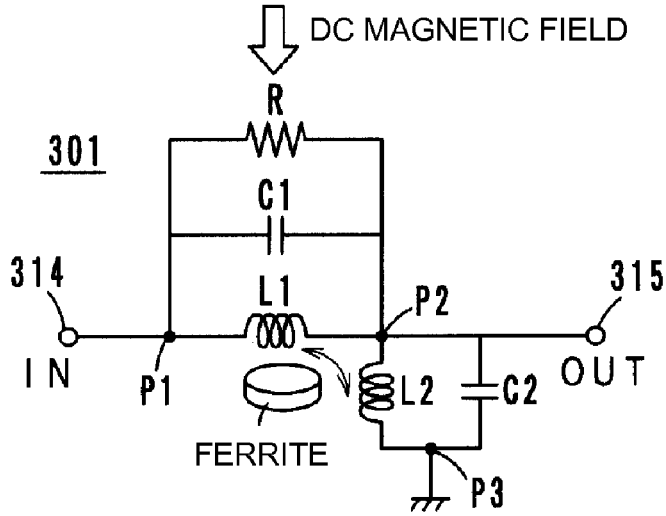
FIG.15 PRIOR ART
FIG. 15 is an electrical equivalent circuit diagram showing a known non-reciprocal circuit device.

A communication apparatus according to another preferred embodiment of the present invention will be described, using a mobile phone as an example. FIG. 14 is a block diagram showing the electrical circuit of a radio-frequency (RF) section of a mobile phone 220. Referring to FIG. 14, reference numeral 222 denotes an antenna element, reference numeral 223 denotes a duplexer, reference numeral 231 denotes a transmitter-side isolator, reference numeral 232 denotes a transmitter-side amplifier, reference numeral 233 denotes a transmitter-side inter-state bandpass filter, reference numeral 234 denotes a transmitter-side mixer, reference numeral 235 denotes a receiver-side amplifier, reference numeral 236 denotes a receiver-side inter-state bandpass filter, reference numeral 237 denotes a receiver-side mixer, reference numeral 238 denotes a voltage controlled oscillator (VCO), and reference numeral 239 denotes a local bandpass filter.

Any of the two-port isolators 1A to 1E having the features described above can be used as the transmitter-side isolator 231 in the mobile phone 220. Mounting any of these isolators in the mobile phone provides a mobile phone having the forward transmission characteristics in a broader band and of a smaller insertion loss.

While the present invention has been described with reference to examples of various preferred embodiments, it is to be understood that the invention is not limited to the disclosed exemplary embodiments. The present invention can be modified within the scope and concept thereof.

As described above, the present invention is useful for the two-port non-reciprocal circuit device, such as an isolator, used in a microwave band, and a communication apparatus. Particularly, the two-port non-reciprocal circuit device and the communication apparatus according to preferred embodiments of the present invention are excellent in the insertion loss characteristics that can be flexibly adjusted in accordance with the requirements.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A two-port non-reciprocal circuit device comprising:

a permanent magnet;

a ferrite to which a direct-current magnetic field is applied by the permanent magnet;

a first central electrode provided on the ferrite, one end of the first central electrode being electrically connected to an input port, the other end thereof being electrically connected to an output port;

a second central electrode provided on the ferrite intersecting with the first central electrode and being electrically insulated therefrom, one end of the second central electrode being electrically connected to the output port, the other end thereof being electrically connected to a ground port;

a first capacitor electrically connected between the input port and the output port;

a resistor electrically connected between the input port and the output port, a second capacitor electrically connected between the output port and the ground port;

an input terminal; and an output terminal; wherein a third capacitor is connected between at least one of the input port and the input terminal, and the output port and the output terminal, and a capacitor element is electrically connected between the input terminal and the output terminal.

2. A communication apparatus including the two-port non-reciprocal circuit device according to claim 1.

3. The two-port non-reciprocal circuit device according to claim 1, wherein the capacitor element is a chip capacitor.

4. The two-port non-reciprocal circuit device according to claim 1, wherein the third capacitor is connected between the input port and the input terminal.

5. The two-port non-reciprocal circuit device according to claim 1, wherein the third capacitor in connected between the output port and the output terminal.

6. The two-port non-reciprocal circuit device according to claim 1, wherein the third capacitor is connected between the input port and the input terminal, and another third capacitor is connected between the output port and the output terminal.

7. The two-port non-reciprocal circuit device according to claim 1, wherein the first central electrode is wrapped around the ferrite from a first primary surface to a second primary surface thereof.

8. The two-port non-reciprocal circuit device according to claim 1, wherein the second central electrode includes two turns that are helically wound around the ferrite.

9. The two-port non-reciprocal circuit device according to claim 1, wherein the first, second, and the third capacitors, the capacitor element, the resistor, the input terminal, and the output terminal are provided inside or on a multilayer substrate and are sandwiched between electrode films; and the permanent magnet, the ferrite, and a yoke which define a central electrode assembly including the first and the second central electrodes, and a magnetic circuit are provided on the multilayer substrate.

10. The two-port non-reciprocal circuit device according to claim 9, wherein the yoke is made of a ferromagnetic material and is silver plated.

11. The two-port non-reciprocal circuit device according to claim 9, wherein the ferrite is a rectangular prism having first and second primary surfaces arranged substantially perpendicular to the multilayer substrate.

12. The two-port non-reciprocal circuit device according to claim 1, further comprising a resin substrate disposed on the permanent magnet and the ferrite.

13. The two-port non-reciprocal circuit device according to claim 12, wherein the resin substrate includes an electrode provided on a surface thereof to suppress an external electromagnetic effect.

* * * * *